US005486091A

United States Patent [19]

Sharma

[11] Patent Number: 5,486,091

[45] Date of Patent: Jan. 23, 1996

[54] GAS TURBINE AIRFOIL CLOCKING

[75] Inventor: Om P. Sharma, Vernon, Conn.

[73] Assignee: United Technologies Corporation, Hartford, Conn.

[21] Appl. No.: 229,979

[22] Filed: Apr. 19, 1994

[51] Int. Cl.[6] ..... F01D 1/00

[52] U.S. Cl. ..... 415/194; 415/181

[58] Field of Search ..... 415/181, 199.5, 415/193, 194; 73/117.4

[56] References Cited

U.S. PATENT DOCUMENTS

| | | | |
|---|---|---|---|
| 1,474,351 | 11/1923 | Flanders . | |
| 2,384,000 | 9/1945 | Wattendorf | 415/181 |
| 2,406,126 | 8/1946 | Zweifel | 415/194 |
| 2,846,136 | 8/1958 | Zaba | 415/194 |
| 2,991,929 | 7/1961 | Stalker | 415/194 |
| 3,112,866 | 12/1963 | Fortescue | 415/194 |
| 3,475,108 | 10/1969 | Zickuhr | 415/194 |
| 3,953,148 | 4/1976 | Seippel et al. | 415/181 |
| 4,671,738 | 6/1987 | Freeman | 415/181 |
| 4,710,099 | 12/1987 | Matsuura | 415/199.5 |
| 4,968,216 | 11/1990 | Anderson et al. | 415/199.5 |

FOREIGN PATENT DOCUMENTS

| | | | |
|---|---|---|---|
| 594523 | 3/1960 | Canada | 415/193 |
| 114618 | 9/1979 | Japan | 415/193 |
| 594682 | 11/1947 | United Kingdom | 415/193 |
| 676371 | 7/1952 | United Kingdom | 415/193 |

*Primary Examiner*—John T. Kwon
*Attorney, Agent, or Firm*—Edward L. Kochey, Jr.

[57] ABSTRACT

The first stage of vanes (16) and second stage of vanes (24) each contain the same number of vanes. The second stage vanes are located such that the wake flow (38) from the first stage vanes falls on or near the leading edge, after passing through the stage of rotating blades.

7 Claims, 2 Drawing Sheets

GAS TURBINE AIRFOIL CLOCKING

TECHNICAL FIELD

The invention relates to gas turbine engines and in particular to the location of second stage vanes or blades with respect to the first stage vanes or blades.

BACKGROUND OF THE INVENTION

It is known that in a gas turbine engine a vane wake forms as the gas passes between the vanes. This vane wake passes to and through the rotating blade stage on to the second stage vanes. It is further known that vibration can occur in the various blades and vanes because of the pulsations occurring as the gas passes the rotating blades.

It has also been thought that the wake impingement on the second stage vanes themselves reduced the efficiency of the gas turbine.

SUMMARY OF THE INVENTION

I have found the opposite to be true, and that the impingement of the wake of the first vane on the leading edge of the second vane actually results in an increase in the efficiency of operation.

Given a known position of the first stage vanes, a design is carried out for the anticipated longest term operating condition. At this condition the path of the wake flow of the first vane to the second vane is determined. The flowpath through the rotating blades is determined and furthermore the flowpath from the rotating blades to the second vane is established. The leading edge of the second vanes is then located at, or within 25% of the pitch of the second vanes, the wake flow position.

Further improvement is achieved if rather than using the radial average condition, the second vane is aligned throughout a plurality of radial positions. While described here with respect to vanes, similar improvement can be achieved with surrounding rows of blades.

DESCRIPTION OF THE PREFERRED EMBODIMENT

Figure 1:
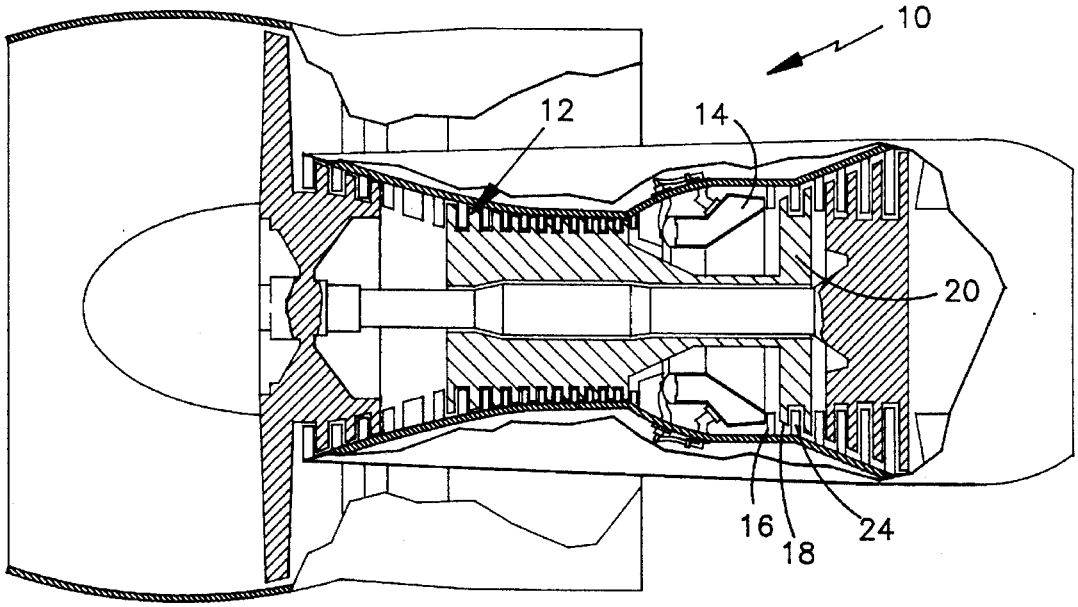
FIG. 1 is an overall view of the gas turbine engine.

Referring to FIG. 1 the gas turbine engine 10 includes a compressor 12 and a combustor 14. This discharges gases through the first stage vanes 16, then through rotating blades 18. These blades are carried on rotor 20.

Figure 2:
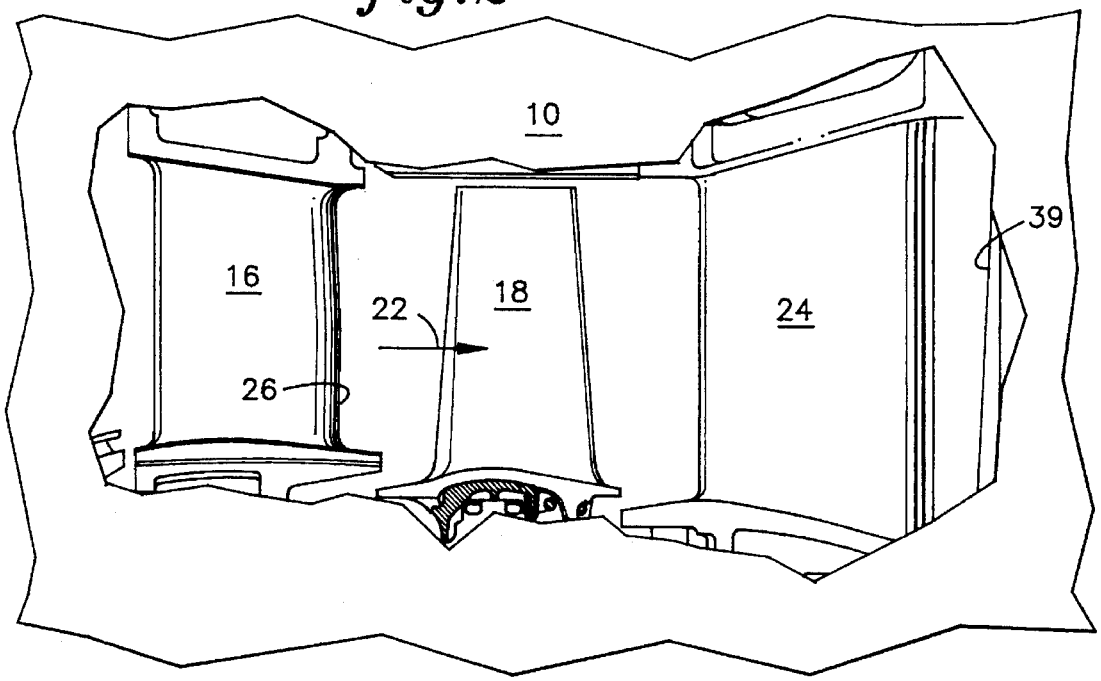
FIG. 2 is a view of the first two vanes and first blades.

Referring to FIG. 2 the gas flow 22 passes by stationary vanes 16 and the rotating blades 18. The flow continues through second stage stationary vanes 24. There are "N" vanes in each of the first and second stages.

Figure 3:
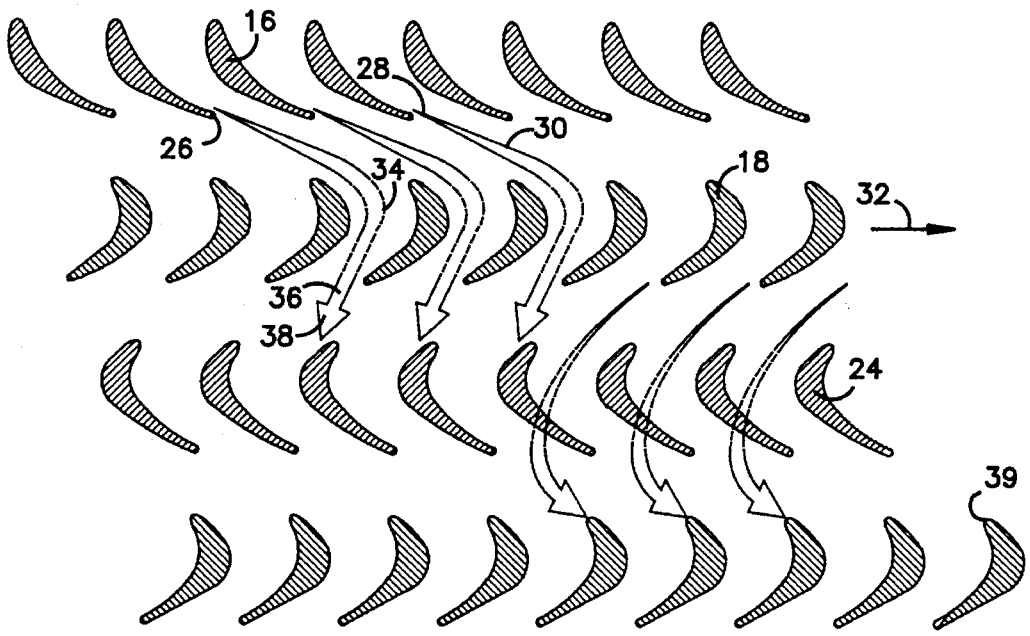
FIG. 3 is a view of the first two vanes and the first two rows of blades shown with the flow pattern.

FIG. 3 shows the vanes and blades along with the flowpath between them. At the trailing edge 26 a first stage vane 16 there is formed a wake 28 which is a turbulent flow area. Knowing the velocity and angle of this wake through flowpath 30 the location of the entrance to blades 18 can be calculated. These blades are moving in their rotation as shown by arrow 32.

Known calculation of the flow triangle establishes a path 34 through the rotating blades leading to the direction and velocity of flowpath 36 leaving the blades. Knowing the distance between the row of blades 18 and the row of vanes 24 one can calculate the entry point 38 into the second stage vanes.

In accordance with my discovery this wake should impinge upon the leading edge 39 of the second stage vanes at the long term operating condition. This results in the optimum efficiency.

Three dimensional unsteady flow calculations can be performed to establish the vane wake leaving vanes 16 in the flow location entering the blades 18. Now the first vane wake convects through the rotor, and its resulting circumferential position into the second vane row can be numerically determined. One method of doing this is a time marching finite volume Euler solver using Ni's scheme. This approach is described in the following references.

1. Ni, R. H. and Bogoian, J. C., "Prediction of 3D Multistage Turbine Flow Field Using a Multiple-Grid Euler Solver", AIAA paper 89–0203.
2. Ni, R. H., Sharma, O. P., Takahashi, R., and Bogoian, J. C., "3D Unsteady Flow Simulation Through a Turbine Stage", paper presented in the 1989 Australian Aeronautical Conference—Research and Technology—The Next Decade, Melbourne, Australia, 1989.
3. Takahashi, R., and Ni, R. H., "Unsteady Euler Analysis of the Redistribution of an Inlet Temperature Distortion in a Turbine", AIAA paper 90–2262, 1990.
4. Ni, R. H., "A Multiple-Grid Scheme for Solving the Euler Equations", AIAA paper 81–1025, 1981, and AIAA Journal Vol. 20, No. 11, 1982.

For this calculation the first vane wake can be created by applying a calibrated surface shear model to the momentum equation as the source term. This wake can then be allowed to pass inviscidly through the rotor so that it's trajectory can be seen with entropy contours. The first vane wake is chopped by the passing rotor into discrete pulses that exit the passage at fixed circumferential locations relative to the second vane. When this flow field is time averaged these pulses appear as a continuous stream into the second vane. It is these time average first vane wakes entering the second vane that establish the clocking of the second vane with respect to the first vane.

The peak efficiency occurs when the calculated time averaged first vane wake impinges upon the second vane leading edge. Conversely, the minimum efficiency occurs when the first vane wake is calculated to be in the second vane mid channel.

Figure 4:
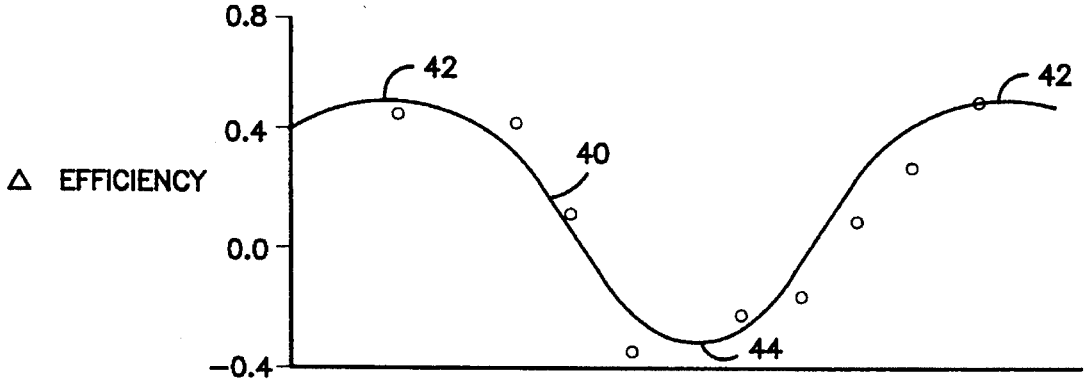
FIG. 4 is a curve showing the effect of clocking.

Referring to FIG. 4 it can be seen that the Δ efficiency curve 40 peaks at locations 42 where the first vane wake is at the center of the second vane. It dips to a minimum at point 44 when the first vane wake passes at the midpoint between second vanes. It can be seen that the precision of the location is not critical and that locations within plus or minus 25% and particularly 15% of the optimum location yield significant improvement. The zero point on this curve which is more or less the center point of the sinusoidal curve is representative of the prior art condition where the number of vanes in the first and second stage are different and accordingly an inherent averaging of the flow performances achieved.

The particular efficiencies shown here are in average of the efficiencies determined over the radial span of the vanes. It is been found that the flowpath varies along the radial span of the vane resulting in different clocking at the different radial positions. Optimum performance is achieved if the vanes are clocked at each radial position.

The above description is specific to the clocking of the first two rows of vanes. It is also applicable to succeeding rows of other airfoils, including blades.

I claim:

1. In a gas turbine engine having N first stage vanes, a plurality of rotating first stage blades, and N second stage vanes there being an arcuate span between each of said second stage vanes, the method of establishing the circumferential position of said second stage vanes with respect to said first stage vanes comprising:

selecting the anticipated longest term operating condition;

determining at said operating condition the path of the wake flow from said first vane to said first blade;

determining at said operating condition the further path of said wake flow passing through said first blades;

determining at said operating condition the further flowpath of said wake flow to said second stage vanes; and locating the leading edge of said second stage vanes within 25% of the pitch of said second stage vanes with respect to said wake flow.

2. The method of claim 1, further comprising:

locating the leading edge of said second stage vanes within 15% of the pitch of said second stage vanes with respect to said wake flow.

3. The method of claim 1, further comprising:

locating the leading edge of said second stage vanes within 5% of the pitch of said second stage vanes with respect to said wake flow.

4. The method of claim 1 wherein:

the step of determining the path of the wake flow from said first row of airfoils to the said second row of airfoils;

the step of determining the further path of said wake flow through said first blade;

the step of determining the further flowpath of said wake flow to the said second row of airfoils;

and the step of locating the leading edge of said airfoils of said third row of airfoils within 25% of the pitch of said third row of airfoils from said wake flow are each repeated for each of a plurality of radial locations along the span of each airfoil.

5. In a gas turbine engine having three succeeding rows of airfoils, the first and third having relative rotation with respect to said second row of airfoils, there being an arcuate span between each of the blades of said third row of blades, the method of establishing the circumferential position of said blades of said third row of blades a respect to the blades of said first row of blades, comprising:

selecting the anticipated longest term operating condition;

determining at said operating condition the path of the wake flow from said first row of airfoils to said second row of airfoils;

determining at said operating condition the further path of said wake flow passing through said second row of airfoils;

determining at said operating condition the further flowpath of said wake flow to said third row of airfoils; and locating the leading edge of said airfoils of said third row of airfoils within 25% of the pitch of said third row of airfoils with respect to said wake flow.

6. The method of claim 5, further comprising:

locating the leading edge of said airfoils of said third row of airfoils within 15% of the pitch of said third row of airfoils with respect to said wake flow.

7. The method of claim 5, further comprising:

locating the leading edge of said airfoils of said third row of airfoils with 5% of the pitch of said third row of airfoils with respect to said wake flow.

* * * * *